US012338537B2

(12) United States Patent
Shimada et al.

(10) Patent No.: US 12,338,537 B2
(45) Date of Patent: Jun. 24, 2025

(54) ELECTROCHEMICAL REACTION DEVICE, METHOD FOR REDUCING CARBON DIOXIDE, AND METHOD FOR PRODUCING CARBON COMPOUND

(71) Applicant: HONDA MOTOR CO., LTD., Tokyo (JP)

(72) Inventors: Yuta Shimada, Wako (JP); Hiroshi Oikawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/681,935

(22) Filed: Feb. 28, 2022

(65) Prior Publication Data

US 2022/0282387 A1 Sep. 8, 2022

(30) Foreign Application Priority Data

Mar. 4, 2021 (JP) ..... 2021-034387

(51) Int. Cl.
*C25B 15/00* (2006.01)
*C25B 3/26* (2021.01)
(Continued)

(52) U.S. Cl.
CPC ..... *C25B 15/08* (2013.01); *C25B 3/26* (2021.01); *C25B 9/19* (2021.01)

(58) Field of Classification Search
CPC ..... C25B 3/26; C25B 9/19; C25B 15/08
See application file for complete search history.

(56) References Cited

U.S. PATENT DOCUMENTS 4,673,473 A 6/1987 Ang et al.
4,952,298 A * 8/1990 Bouche-Pillon ..... C25B 15/02 204/263
11,519,089 B1 * 12/2022 Faure ..... C25B 15/02
(Continued)

FOREIGN PATENT DOCUMENTS

DE 102015201132 7/2016
DE 102019207715 12/2020
(Continued)

OTHER PUBLICATIONS

Japanese Office Action for Japanese Patent Application No. 2021-034387 dated Jul. 26, 2022.
(Continued)

*Primary Examiner* — Zulmariam Mendez
(74) *Attorney, Agent, or Firm* — Amin, Turocy & Watson, LLP

(57) ABSTRACT

What is provided is an electrochemical reaction device into which unreacted carbon dioxide gas is less likely to be mixed in and which is capable of increasing purity of a carbon compound produced through reduction, a method for reducing carbon dioxide, and a method for producing a carbon compound. In an electrochemical reaction device electrochemically reducing carbon dioxide, an electrolyte flow path is formed which is provided between a cathode and an anode and through which an electrolyte containing a strong alkaline aqueous solution is supplied, a cathode-side gas flow path is formed which is provided on the cathode side opposite to the anode and through which carbon dioxide gas is supplied, liquid flow path closing means for openably closing an entrance of the electrolyte flow path is provided, and gas flow path closing means for openably closing an entrance of the cathode-side gas flow path is formed.

5 Claims, 7 Drawing Sheets

(51) Int. Cl.
*C25B 9/19* (2021.01)
*C25B 15/08* (2006.01)

(56) References Cited

U.S. PATENT DOCUMENTS

| | | | | |
|---|---|---|---|---|
| 2013/0186771 | A1 | 7/2013 | Zhai et al. | |
| 2017/0073827 | A1 | 3/2017 | Tamura et al. | |
| 2019/0078222 | A1 | 3/2019 | Baldauf et al. | |
| 2019/0127865 | A1* | 5/2019 | Li | C25B 3/26 |
| 2019/0233957 | A1 | 8/2019 | Jeanty et al. | |
| 2019/0233958 | A1* | 8/2019 | Jeanty | C25B 11/031 |
| 2020/0087233 | A1* | 3/2020 | Ono | C25B 9/73 |

FOREIGN PATENT DOCUMENTS

| | | |
|---|---|---|
| EP | 3831982 | 6/2021 |
| JP | 2013-544957 | 12/2013 |
| JP | 2017-057491 | 3/2017 |
| JP | 2019-167556 | 10/2019 |
| JP | 2020-128311 | 8/2020 |
| KR | 10-2019-0128497 | 11/2019 |
| RU | 2008142177 | 4/2010 |
| WO | 2018/232515 | 12/2018 |
| WO | 2019/025092 | 2/2019 |
| WO | 2020/109295 | 6/2020 |
| WO | 2020/121556 | 6/2020 |
| WO | 2020/212139 | 10/2020 |

OTHER PUBLICATIONS

Chinese Office Action for Chinese Patent Application No. 202210164419.5 mailed Jul. 8, 2023.

* cited by examiner

ELECTROCHEMICAL REACTION DEVICE, METHOD FOR REDUCING CARBON DIOXIDE, AND METHOD FOR PRODUCING CARBON COMPOUND

BACKGROUND OF THE INVENTION

Field of the Invention

The present invention relates to an electrochemical reaction device, a method for reducing carbon dioxide, and a method for producing a carbon compound.

Description of Related Art

Technology for obtaining useful substances from carbon dioxide as a raw material is promising technology that has a possibility to achieve carbon neutrality. In particular, technology for electrochemically reducing carbon dioxide is very useful. Patent Document 1 discloses that a catalyst layer is formed on a side in contact with an electrolyte of a gas diffusion layer using a carbon dioxide reduction catalyst to serve as a cathode, and carbon dioxide gas is supplied from a side opposite to the catalyst layer of the gas diffusion layer to electrochemically reduce the carbon dioxide gas.

PATENT DOCUMENT

[Patent Document 1] PCT International Publication No. WO2018/232515

SUMMARY OF THE INVENTION

However, in the technique in the related art in which carbon dioxide gas is supplied to the cathode, unreacted carbon dioxide gas is likely to be mixed with a gaseous carbon compound such as ethylene produced through the reduction of carbon dioxide. For this reason, in a case where the obtained carbon compound is used, it is necessary to separate the unreacted carbon dioxide gas, which increases costs and deteriorates the energy efficiency. From this, it can be said that it is significant from the viewpoints of cost and energy saving to develop an electrochemical reaction device in which unreacted carbon dioxide gas is less likely to be mixed with a carbon compound produced through reduction.

An object of the present invention is to provide an electrochemical reaction device into which unreacted carbon dioxide gas is less likely to be mixed and which is capable of increasing purity of a carbon compound produced through reduction, a method for reducing carbon dioxide, and a method for producing a carbon compound.

The present invention has adopted the following aspects.

(1) An electrochemical reaction device (for example, an electrochemical reaction device 2 of an embodiment) according to an aspect of the present invention is an electrochemical reaction device that electrochemically reduces carbon dioxide including: a cathode (for example, a cathode 113 of an embodiment); an anode (for example, an anode 115 of an embodiment); an electrolyte flow path (for example, an electrolyte flow path 121 of an embodiment) which is provided between the cathode and the anode and through which an electrolyte containing a strong alkaline aqueous solution is supplied; a cathode-side gas flow path (for example, a cathode-side gas flow path 122 of an embodiment) which is provided on the cathode side opposite to the anode and through which carbon dioxide gas is supplied; liquid flow path closing means (for example, liquid flow path closing means 119 of an embodiment) for openably closing an outlet of the electrolyte flow path; and gas flow path closing means (for example, gas flow path closing means 118 of an embodiment) for openably closing an outlet of the cathode-side gas flow path.

(2) A method for reducing carbon dioxide according to an aspect of the present invention is a method for electrochemically reducing carbon dioxide including: electrochemically reducing carbon dioxide gas in a state in which an electrolyte containing a strong alkaline aqueous solution is accommodated in an electrolyte flow path which is located between a cathode and an anode and of which an entrance is closed and in a state in which the carbon dioxide gas is accommodated in a cathode-side gas flow path which is on the cathode side opposite to the anode and of which an entrance is closed, to dissolve the unreacted carbon dioxide gas in the electrolyte.

(3) A method for producing a carbon compound according to an aspect of the present invention includes: electrochemically reducing carbon dioxide through the method for reducing carbon dioxide according to (2) to produce the carbon compound.

According to the aspects (1) to (3), it is possible to provide an electrochemical reaction device into which unreacted carbon dioxide gas is less likely to be mixed and which is capable of increasing purity of a carbon compound produced through reduction, a method for reducing carbon dioxide, and a method for producing a carbon compound.

DETAILED DESCRIPTION OF THE INVENTION

Hereinafter, embodiments of the present invention will be described with reference to the drawings. The dimensions and the like of the drawings provided in the following description are merely exemplary examples, and the present invention is not necessarily limited thereto and can be implemented with appropriate modifications within a range that does not change the gist thereof.

Electrochemical Reaction Device

Figure 1:
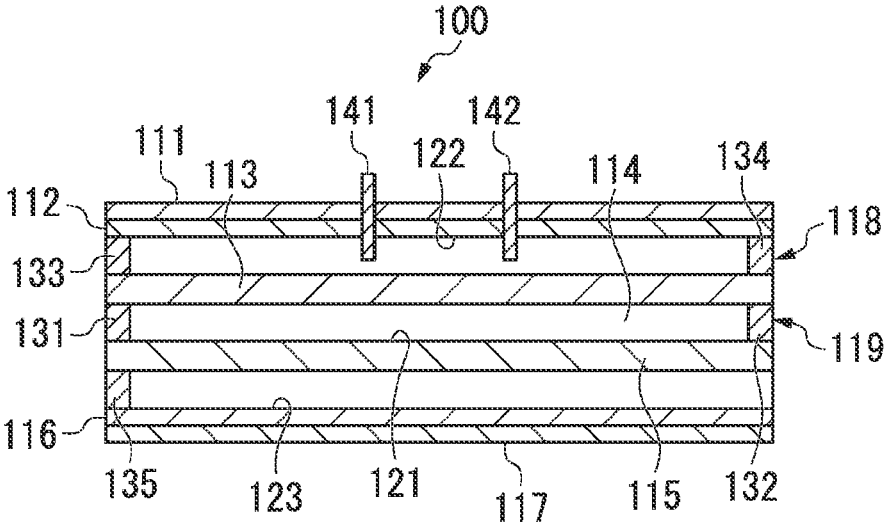
FIG. 1 is a cross-sectional view illustrating an electrochemical reaction device of an embodiment.

An electrochemical reaction device 100 according to an aspect of the present invention provided as an exemplary example in FIG. 1 is a device for electrochemically reducing carbon dioxide.

In the electrochemical reaction device 100, a first power supply body 111, a first gas flow path structure 112, a cathode 113, a liquid flow path structure 114, an anode 115, a second gas flow path structure 116, and a second power supply body 117 are stacked in that order.

A slit is formed in the liquid flow path structure 114, and a portion of the slit surrounded by the liquid flow path structure 114, the cathode 113, and the anode 115 forms an electrolyte flow path 121. A groove is formed in the first gas flow path structure 112 on a side where the cathode 113 is placed, and a portion of the groove surrounded by the first gas flow path structure 112 and the cathode 113 forms a cathode-side gas flow path 122. A groove is formed in the second gas flow path structure 116 on a side where the anode 115 is placed, and a portion of the groove surrounded by the second gas flow path structure 116 and the anode 115 forms a gas exhaust path 123.

In this manner, in the electrochemical reaction device 100, the electrolyte flow path 121 is formed between the cathode 113 and the anode 115, the cathode-side gas flow path 122 is formed on the cathode 113 side opposite to the anode 115, and the gas exhaust path 123 is formed on the anode 115 side opposite to the cathode 113.

The first power supply body 111 and the second power supply body 117 are electrically connected to a power source not shown in the drawing. In addition, the first gas flow path structure 112 and the second gas flow path structure 116 are conductors, and the first power supply body 111 and the second power supply body 117 can be supplied with electric power from the power source to apply a voltage between the cathode 113 and the anode 115.

The cathode 113 is an electrode that reduces carbon dioxide and water. As the cathode 113, any one may be used as long as it can electrochemically reduce carbon dioxide and allows a gaseous product produced through the reduction to permeate. Examples of the cathode 113 include an electrode having a cathode catalyst layer formed on the electrolyte flow path 121 side of a gas diffusion layer. A part of the cathode catalyst layer may penetrate the gas diffusion layer. A porous layer that is denser than the gas diffusion layer may be placed between the gas diffusion layer and the cathode catalyst layer.

A well-known catalyst that reduces carbon dioxide to produce a carbon compound can be used as a cathode catalyst forming the cathode catalyst layer. Specific examples of cathode catalysts include metals such as gold, silver, copper, platinum, palladium, nickel, cobalt, iron, manganese, titanium, cadmium, zinc, indium, gallium, lead, and tin, alloys or intermetallic compounds thereof, and metal complexes such as a ruthenium complex and a rhenium complex. As the cathode catalyst, a supported catalyst in which metal particles are supported on carbon materials (such as carbon particles, carbon nanotubes, or graphene) may be used. Among them, copper is preferable as a cathode catalyst because it promotes the reduction of carbon dioxide gas. One cathode catalysts may be used alone or a combination of two or more thereof may be used.

The gas diffusion layer of the cathode 113 is not particularly limited, but examples thereof include carbon paper and carbon cloth.

A method for producing the cathode 113 is not particularly limited, but examples thereof include: a method of applying a liquid composition containing a cathode catalyst to the surface of a gas diffusion layer through sputtering, and drying it; and a method of vapor-depositing a metal serving as a cathode catalyst on the surface of a gas diffusion layer using an arc plasma gun.

The anode 115 is an electrode that oxidizes hydroxide ions. As the anode 115, any one may be used as long as it can electrochemically oxidize hydroxide ions and allows produced oxygen to permeate. Examples of the anode 115 include an electrode having an anode catalyst layer formed on the electrolyte flow path 121 side of a gas diffusion layer.

The anode catalyst forming an anode catalyst layer is not particularly limited, and a well-known anode catalyst can be used. Specific examples thereof include metals such as platinum, palladium, and nickel, alloys or intermetallic compounds thereof, metal oxides such as manganese oxide, iridium oxide, nickel oxide, cobalt oxide, iron oxide, tin oxide, indium oxide, ruthenium oxide, lithium oxide, and lanthanum oxide, and metal complexes such as a ruthenium complex and a rhenium complex. One anode catalyst may be used alone or a combination of two or more thereof may be used.

Examples of the gas diffusion layer of the anode 115 include carbon paper and carbon cloth. In addition, a porous body such as a mesh material, a punched material, or a metal fiber sintered body may be used as the gas diffusion layer. Examples of materials of porous bodies include metals such as titanium, nickel, and iron, and alloys thereof (for example, SUS).

Examples of materials of the liquid flow path structure 114 include fluororesins such as polytetrafluoroethylene.

Examples of materials of the first gas flow path structure 112 and the second gas flow path structure 116 include metals such as titanium and SUS and carbon.

Examples of materials of the first power supply body 111 and the second power supply body 117 include metals such as copper, gold, titanium, and SUS, and carbon. Copper base materials of which the surfaces are plated with gold or the like may be used for the first power supply body 111 and the second power supply body 117.

The electrochemical reaction device 100 may further include the liquid flow path closing means 119 and the gas flow path closing means 118.

The liquid flow path closing means 119 includes a first liquid electromagnetic valve 131 and a second liquid electromagnetic valve 132 which openably close entrances of the electrolyte flow path 121. The first liquid electromagnetic valve 131 is provided in an inlet of the electrolyte flow path 121. The second liquid electromagnetic valve 132 is provided in an outlet of the electrolyte flow path 121. By closing the first liquid electromagnetic valve 131 and the second liquid electromagnetic valve 132, the entrances of the electrolyte flow path 121 can be closed.

The gas flow path closing means 118 includes a first gas electromagnetic valve 133 and a second gas electromagnetic valve 134 which openably close entrances of the cathode-side gas flow path 122. The first gas electromagnetic valve 133 is provided in an inlet of the cathode-side gas flow path 122. The second gas electromagnetic valve 134 is provided in an outlet of the cathode-side gas flow path 122. By closing the first gas electromagnetic valve 133 and the second gas electromagnetic valve 134, the entrances of the cathode-side gas flow path 122 can be closed.

A third gas electromagnetic valve 135 is provided in an inlet of the gas exhaust path 123.

A pressure sensor 141 for monitoring the pressure in the cathode-side gas flow path 122 and a carbon dioxide sensor 142 for monitoring the carbon dioxide concentration are provided in the cathode-side gas flow path 122.

Figure 2:
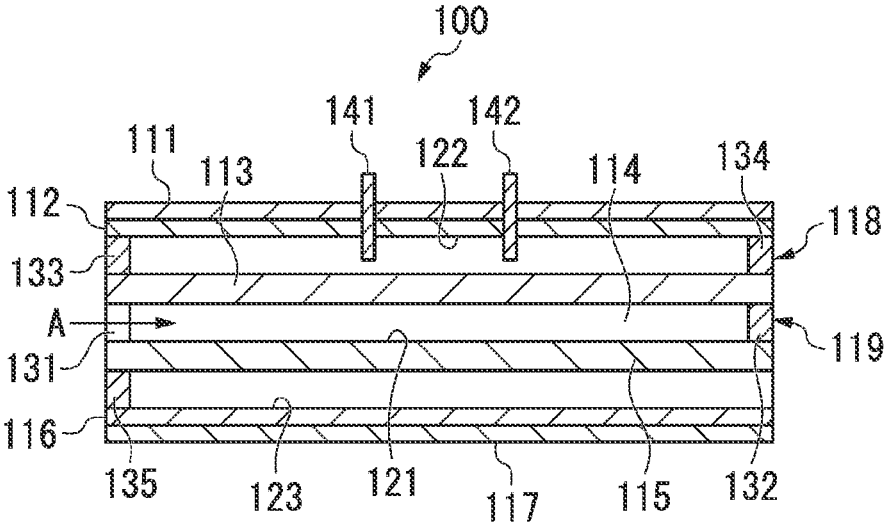
FIG. 2 is a cross-sectional view illustrating a procedure of reducing carbon dioxide of the electrochemical reaction device of FIG. 1.
Figure 3:
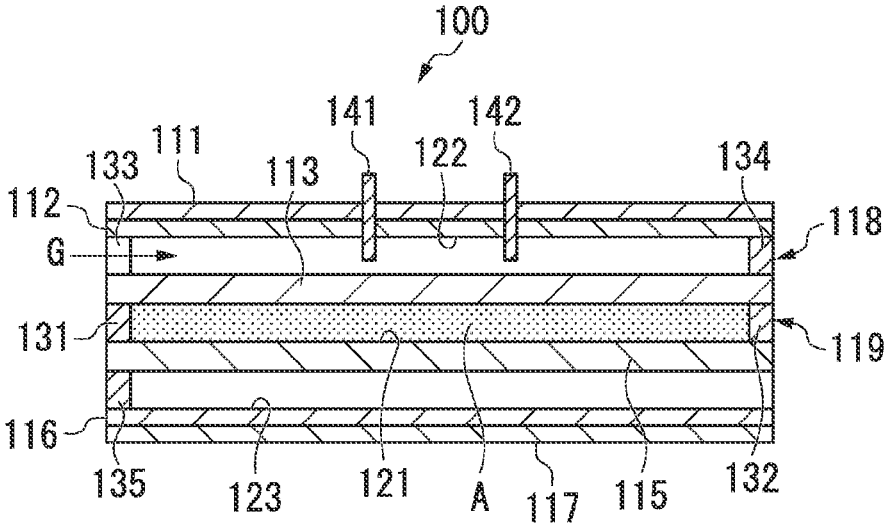
FIG. 3 is a cross-sectional view illustrating a procedure of reducing carbon dioxide of the electrochemical reaction device of FIG. 1.
Figure 4:
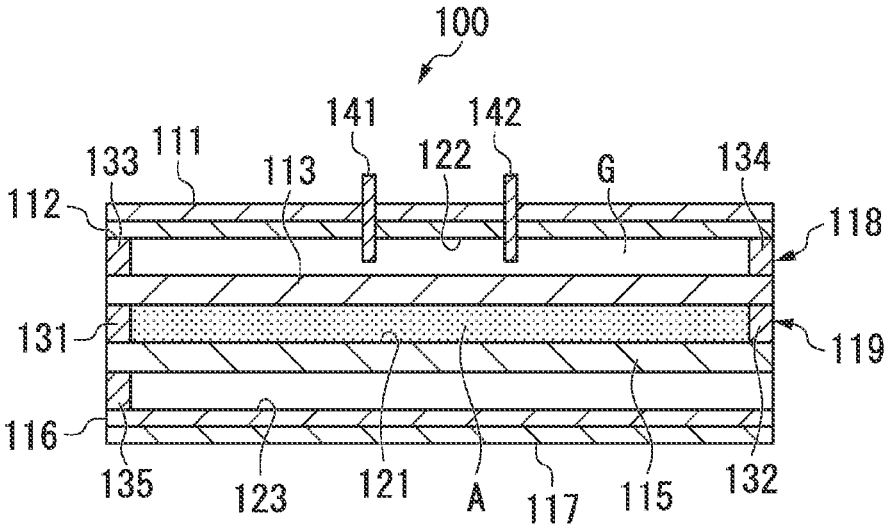
FIG. 4 is a cross-sectional view illustrating a procedure of reducing carbon dioxide of the electrochemical reaction device of FIG. 1.

In the electrochemical reaction device 100, an electrolyte A containing a strong alkaline aqueous solution can be supplied to the electrolyte flow path 121 in a state in which the second liquid electromagnetic valve 132 is closed and the first liquid electromagnetic valve 131 is open as shown in FIG. 2. Then, as shown in FIG. 3, the entrances of the electrolyte flow path 121 can be closed in a state in which the electrolyte A is accommodated by closing the first liquid electromagnetic valve 131. In addition, as shown in FIG. 3, carbon dioxide gas G can be supplied to the cathode-side gas flow path 122 in a state in which the second gas electromagnetic valve 134 is closed and the first gas electromagnetic valve 133 is open. Then, as shown in FIG. 4, the entrances of the cathode-side gas flow path 122 can be closed in a state in which the carbon dioxide gas G is accommodated by closing the first gas electromagnetic valve 133.

Method for Reducing Carbon Dioxide

A method for reducing carbon dioxide according to an aspect of the present invention is a method for electrochemically reducing carbon dioxide. In the method for reducing carbon dioxide according to one aspect of the present invention, carbon dioxide gas is electrochemically reduced in a state in which an electrolyte containing a strong alkaline aqueous solution is accommodated in an electrolyte flow path which is located between a cathode and an anode and of which an entrance is closed and in a state in which the carbon dioxide gas is accommodated in a cathode-side gas flow path which is on the cathode side opposite to the anode and of which an entrance is closed, to dissolve the unreacted carbon dioxide gas in the electrolyte.

The method for reducing carbon dioxide of the present invention can be used in a method for producing a carbon compound. That is, by using the method for reducing carbon dioxide of the present invention, it is possible to produce a carbon compound obtained by reducing carbon dioxide or a carbon compound synthesized using a carbon compound obtained by reducing carbon dioxide as a raw material. For example, ethylene can be produced through the method for reducing carbon dioxide of the present invention.

Hereinafter, the method for reducing carbon dioxide will be described by taking a case of using the above-described electrochemical reaction device 100 as an example.

For example, the first liquid electromagnetic valve 131, the second liquid electromagnetic valve 132, the first gas electromagnetic valve 133, the second gas electromagnetic valve 134, the third gas electromagnetic valve 135 of the electrochemical reaction device 100 are all closed as shown in FIG. 1. As shown in FIG. 2, the first liquid electromagnetic valve 131 is open, and the electrolyte A containing a strong alkaline aqueous solution is supplied to the electrolyte flow path 121. Then, as shown in FIG. 3, the first liquid electromagnetic valve 131 is closed, and the entrances of the electrolyte flow path 121 can be closed in a state in which the electrolyte A is accommodated.

In addition, as shown in FIG. 3, the first gas electromagnetic valve 133 is open, and the carbon dioxide gas G is supplied to the cathode-side gas flow path 122 while monitoring the pressure and the carbon dioxide concentration in the cathode-side gas flow path 122 using the pressure sensor 141 and the carbon dioxide sensor 142. Then, when the concentration of carbon dioxide in the cathode-side gas flow path 122 reaches a predetermined value, a voltage is applied between the cathode 113 and the anode 115. In addition, the first gas electromagnetic valve 133 is closed when the pressure in the cathode-side gas flow path 122 reaches a predetermined value (for example, 80% of a supply pressure), and the entrances of the cathode-side gas flow path 122 are closed in a state in which the carbon dioxide gas G is accommodated as shown in FIG. 4.

A voltage is continuously applied to the cathode 113 and the anode 115 in this state, and the carbon dioxide gas G is electrochemically reduced at the cathode 113 while the voltage is controlled according to a decrease in the concentration of carbon dioxide in the cathode-side gas flow path 122. When carbon dioxide is reduced at the cathode 113, carbon monoxide and ethylene are mainly produced as carbon compounds by the following reaction. In addition, hydrogen is also produced at the cathode 113 by the following reaction. These gaseous products permeate a gas diffusion layer of the cathode 113 toward the cathode-side gas flow path 122 side.

$$CO_2+H_2O \rightarrow CO+2OH^-$$

$$2CO+8H_2O \rightarrow C_2H_4+8OH^-+2H_2O$$

$$2H_2O \rightarrow H_2+2OH^-$$

In addition, hydroxide ions produced at the cathode 113 move in the electrolyte A toward the anode 115 and are oxidized by the following reaction to produce oxygen. By closing the third gas electromagnetic valve 135 and keeping the gas exhaust path 123 at a negative pressure, the produced oxygen quickly permeates a gas diffusion layer of the anode 115 and is discharged through the gas exhaust path 123.

$$4OH^- \rightarrow O_2+2H_2O$$

Carbon dioxide has a property that it is more easily dissolved in an alkaline aqueous solution than gaseous products such as ethylene and hydrogen produced by reduction. On the other hand, since the reduction reaction rate of carbon dioxide is high under high current conditions, the dissolution of carbon dioxide in the electrolyte A is suppressed.

From these facts, the reduction of carbon dioxide is first performed under high current conditions in a state where the entrances of the electrolyte flow path 121 in which the electrolyte A is accommodated and the entrances of the cathode-side gas flow path 122 in which the carbon dioxide gas G is accommodated are closed. Then, the reduction of carbon dioxide in the cathode-side gas flow path 122 is promoted while the dissolution of the carbon dioxide in the electrolyte A is suppressed, and therefore the yield of ethylene increases. In addition, in a state where the voltage is reduced according to the decrease in the concentration of carbon dioxide in the cathode-side gas flow path 122 and the current flowing through the electrolyte A is reduced and in a case where the application of the voltage is stopped, unreacted carbon dioxide gas G remaining in the cathode-side gas flow path 122 is selectively dissolved in the electrolyte A. As a result, a gaseous product C in the cathode-side gas flow path 122 after the reaction becomes a gas having a low carbon dioxide concentration and a high ethylene concentration.

The conditions for reducing carbon dioxide while dissolution of carbon dioxide in the electrolyte A is suppressed may be appropriately set, and the current value between the cathode 113 and the anode 115 can be set, for example, to 300 to 600 mA/cm$^2$.

Examples of strong alkaline aqueous solutions used in the electrolyte A include a potassium hydroxide aqueous solution and a sodium hydroxide aqueous solution. Of these, a potassium hydroxide aqueous solution is preferable from the viewpoints of excellent solubility of carbon dioxide and promotion of reduction of carbon dioxide.

Figure 5:
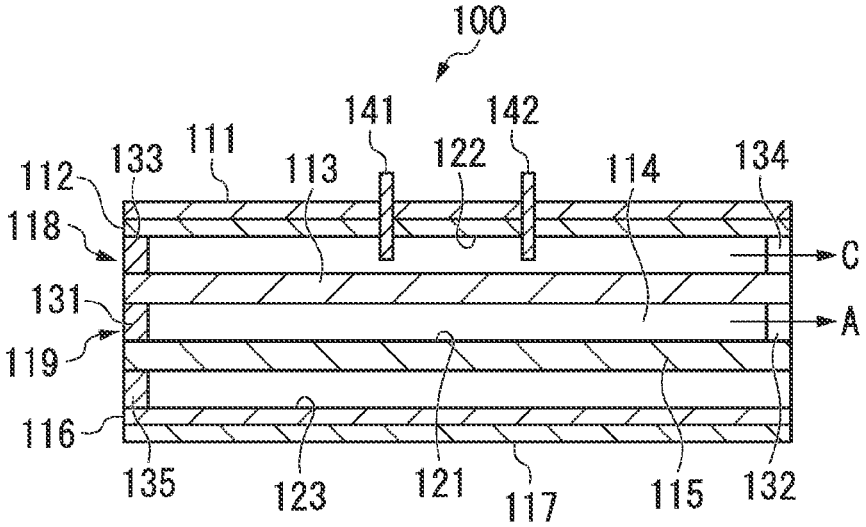
FIG. 5 is a cross-sectional view illustrating a procedure of reducing carbon dioxide of the electrochemical reaction device of FIG. 1.

For example, after the concentration of carbon dioxide in the cathode-side gas flow path 122 reaches the minimum value, the second gas electromagnetic valve 134 and the second liquid electromagnetic valve 132 are open to discharge the gaseous product C of the cathode-side gas flow path 122 and the electrolyte A of the electrolyte flow path 121 as shown in FIG. 5.

As described above, in the electrochemical reaction device and the method for reducing carbon dioxide, the carbon dioxide gas G is electrochemically reduced in a state where the electrolyte A is accommodated in the electrolyte flow path 121 with entrances closed and the carbon dioxide gas G is accommodated in the cathode-side gas flow path 122 with entrances closed. Accordingly, since unreacted carbon dioxide remaining can be dissolved in the electrolyte A after carbon dioxide is reduced while the dissolution of the carbon dioxide in the electrolyte A is suppressed, the purity of ethylene in the gaseous product C obtained increases. For this reason, valuables can be obtained from the carbon dioxide at low cost and high energy efficiency.

The present invention is not limited to the above-described electrochemical reaction device 100 and the method for reducing carbon dioxide using the same. It is possible to appropriately replace constituent elements in the embodiment with well-known constituent elements within the scope not departing from the gist of the present invention.

Carbon Dioxide Treatment Device

Figure 6:
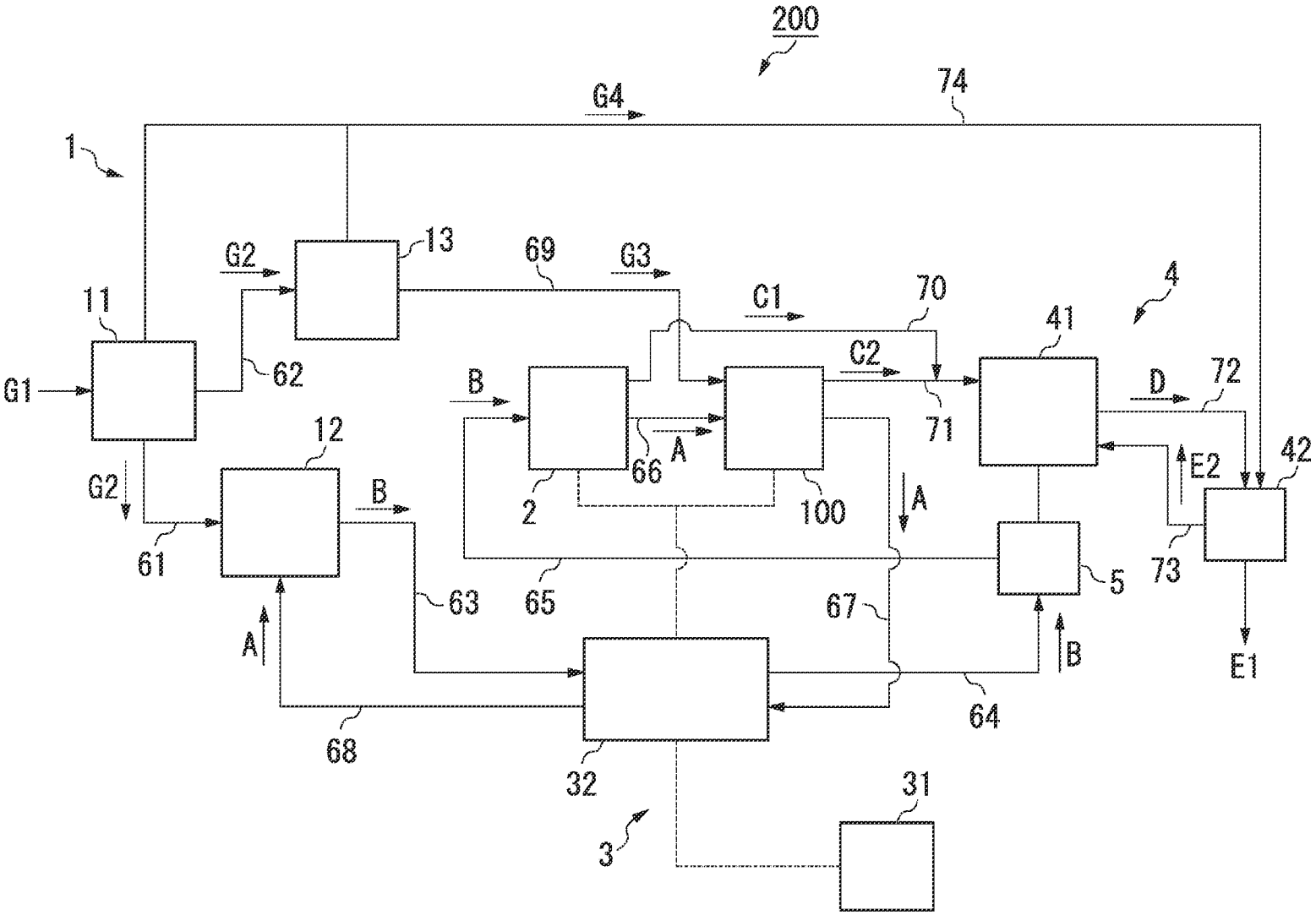
FIG. 6 is a block diagram illustrating an example of a carbon dioxide treatment device including an electrochemical reaction device of an embodiment.

Hereinafter, an example of using the electrochemical reaction device of the embodiment will be shown. The electrochemical reaction device 100 of the embodiment can be used, for example, in a carbon dioxide treatment device 200 shown in FIG. 6.

The carbon dioxide treatment device 200 includes a recovery device 1, an electrochemical reaction device (first electrochemical reaction device) 2, an electrochemical reaction device (second electrochemical reaction device) 100, a power source storage device 3, a homologation reaction device 4, and a heat exchanger 5. The recovery device 1 includes a concentration unit 11, an absorption unit 12, and a concentration unit 13. The power source storage device 3 includes a conversion unit 31 and a storage unit 32 electrically connected to the conversion unit 31. The homologation reaction device 4 includes a reactor 41 and a gas-liquid separator 42.

In the carbon dioxide treatment device 200, the concentration unit 11 and the absorption unit 12 are connected to each other through a gas flow path 61. The concentration unit 11 and the concentration unit 13 are connected to each other through a gas flow path 62. The absorption unit 12 and the storage unit 32 are connected to each other through a liquid flow path 63 and a liquid flow path 68. The storage unit 32 and the heat exchanger 5 are connected to each other through a liquid flow path 64. The heat exchanger 5 and the electrochemical reaction device 2 are connected to each other through a liquid flow path 65. The electrochemical reaction device 2 and the electrochemical reaction device 100 are connected to each other through a liquid flow path 66. The electrochemical reaction device 100 and the storage unit 32 are connected to each other through a liquid flow path 67. The electrochemical reaction device 2 and the reactor 41 are connected to each other through a gas flow path 70. The electrochemical reaction device 100 and the reactor 41 are connected to each other through a gas flow path 71. The reactor 41 and the gas-liquid separator 42 are connected to each other through a gas flow path 72 and a gas flow path 73. The concentration units 11 and 13 the gas-liquid separator 42 are connected to each other through a gas flow path 74.

These flow paths are not particularly limited, and well-known pipes can be appropriately used. Gas feeding means such as a compressor, pressure reduction valves, or measuring instruments such as a pressure gauge can be appropriately installed in the gas flow paths 61, 62, 70 to 73, and 74. In addition, liquid feeding means such as a pump or measuring instruments such as a flowmeter can be appropriately installed in the liquid flow paths 63 to 68.

The recovery device 1 is a device that recovers carbon dioxide.

A gas G1, such as atmospheric air or an exhaust gas, containing carbon dioxide is supplied to the concentration unit 11. The carbon dioxide of the gas G1 is concentrated in the concentration unit 11. Any well-known concentration device can be employed as the concentration unit 11 as long as it can concentrate carbon dioxide. For example, a membrane separation device in which the difference in permeation rate with respect to membranes is used, and an adsorption separation device in which chemical or physical adsorption and desorption are used can be used. Among them, a membrane separation device is preferable as the concentration unit 11 from the viewpoint of energy efficiency.

A part of a concentrated gas G2 obtained by concentrating the carbon dioxide in the concentration unit 11 is sent to the absorption unit 12 through the gas flow path 61, and the remainder is sent to the concentration unit 13 through the gas flow path 62. The carbon dioxide of the concentrated gas G2 supplied from the concentration unit 11 is further concentrated in the concentration unit 13. The concentration unit 13 is not particularly limited. The concentration unit 11 is an exemplary example, and a membrane separation device is preferable. A concentrated gas G3 obtained by further concentrating the carbon dioxide in the concentration unit 13 is supplied to the cathode-side gas flow path 122 of the electrochemical reaction device 100 through a gas flow path 69. In addition, a separation gas G4 separated from the concentrated gases G2 and G3 in the concentration units 11 and 13 is sent to the gas-liquid separator 42 through the gas flow path 74.

In the absorption unit 12, the carbon dioxide gas in the concentrated gas G2 supplied from the concentration unit 11 comes into contact with the electrolyte A and is dissolved and absorbed in the electrolyte A. The technique of bringing the carbon dioxide gas into contact with the electrolyte A is not particularly limited, and examples thereof include a technique of blowing the concentrated gas G2 into the electrolyte A for bubbling.

In the absorption unit 12, the electrolyte A containing a strong alkaline aqueous solution is used as an absorption liquid for absorbing carbon dioxide. As described above, since carbon dioxide is likely to be dissolved in the strong alkaline aqueous solution, the carbon dioxide in the concentrated gas G2 is selectively absorbed in the electrolyte A in the absorption unit 12. In this manner, the concentration of carbon dioxide can be assisted using the electrolyte A in the absorption unit 12. For this reason, it is unnecessary for the carbon dioxide to be concentrated to a high concentration in the concentration unit 11, and the energy required for the concentration in the concentration unit 11 can be reduced.

An electrolyte B in which the carbon dioxide is absorbed in the absorption unit 12 is sent to the electrochemical reaction device 2 through the liquid flow path 63, the storage unit 32, the liquid flow path 64, the heat exchanger 5, and the liquid flow path 65. In addition, the electrolyte A flowing out of the electrochemical reaction device 2 is sent to the electrochemical reaction device 100 through the liquid flow path 66. Furthermore, the electrolyte A flowing out of the electrochemical reaction device 100 is sent to the absorption unit 12 through the liquid flow path 67, the storage unit 32, and the liquid flow path 68. In this manner, electrolytes circulate and are shared between the absorption unit 12, the storage unit 32, the electrochemical reaction device 2, and the electrochemical reaction device 100 in the carbon dioxide treatment device 200.

Figure 7:
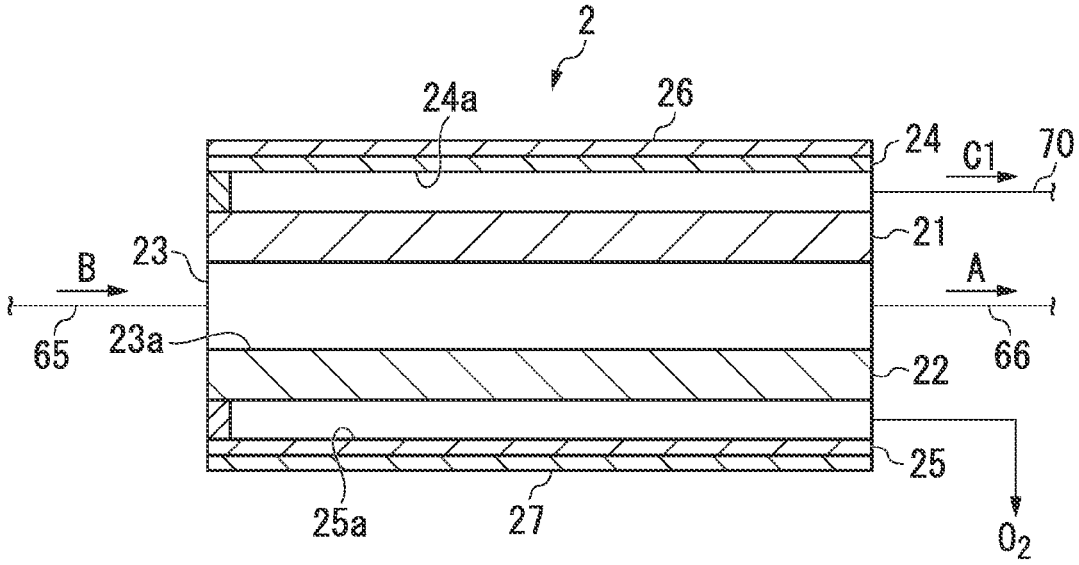
FIG. 7 is a cross-sectional view illustrating a first electrochemical reaction device of the carbon dioxide treatment device of FIG. 6.

The electrochemical reaction device 2 is a device for electrochemically reducing carbon dioxide. As shown in FIG. 7, the electrochemical reaction device 2 includes a cathode 21, an anode 22, a liquid flow path structure 23 for forming a liquid flow path 23*a*, a first gas flow path structure 24 that forms a gas flow path 24*a*, a second gas flow path structure 25 that forms a gas flow path 25*a*, a first power supply body 26, and a second power supply body 27.

In the electrochemical reaction device 2, the first power supply body 26, the first gas flow path structure 24, the cathode 21, the liquid flow path structure 23, the anode 22, the second gas flow path structure 25, and the second power supply body 27 are stacked in that order. A slit is formed in the liquid flow path structure 23, and a region of the slit surrounded by the cathode 21, the anode 22, and the liquid flow path structure 23 forms a liquid flow path 23*a*. A groove is formed on the cathode 21 side of the first gas flow path structure 24, and a portion of the groove surrounded by the first gas flow path structure 24 and the cathode 21 forms the gas flow path 24*a*. A groove is formed on the anode 22 side of the second gas flow path structure 25, and a portion of the groove surrounded by the second gas flow path structure 25 and the anode 22 forms the gas flow path 25*a*.

In this manner, in the electrochemical reaction device 2, the liquid flow path 23*a* is formed between the cathode 21 and the anode 22, the gas flow path 24*a* is formed on the cathode 21 side opposite to the anode 22, and the gas flow path 25*a* is formed on the anode side opposite to the cathode 21. The first power supply body 26 and the second power supply body 27 are electrically connected to the storage unit 32 of the power source storage device 3. In addition, the first gas flow path structure 24 and the second gas flow path structure 25 are conductors, and a voltage can be applied between the cathode 21 and the anode 22 due to electric power supplied from the storage unit 32.

Examples of the cathode 21 and the anode 22 include the same ones as the cathode 113 and the anode 115 provided as exemplary examples in the electrochemical reaction device 100. Examples of the liquid flow path structure 23, the first gas flow path structure 24, the second gas flow path structure 25, the first power supply body 26, and the second power supply body 27 include the same ones as the liquid flow path structure 114, the first gas flow path structure 112, the second gas flow path structure 116, the first power supply body 111, and the second power supply body 117 provided as exemplary examples in the electrochemical reaction device 100.

The electrochemical reaction device 2 is a flow cell in which the electrolyte B supplied from the absorption unit 12 flows through the liquid flow path 23*a*. When a voltage is applied to the cathode 21 and the anode 22, dissolved carbon dioxide in the electrolyte B flowing through the liquid flow path 23*a* is electrochemically reduced at the cathode 21 and a carbon compound and hydrogen are produced. Since carbon dioxide is dissolved in the electrolyte B at the inlet of the liquid flow path 23*a*, the electrolyte B is in a weak alkaline state in which the abundance ratio of $CO_3^{2-}$ is high as described above. On the other hand, the amount of dissolved carbon dioxide decreases as the reduction progresses, and the electrolyte A in a strong alkaline state is obtained at the outlet of the liquid flow path 23*a*.

In this manner, in the carbon dioxide treatment device 200, the electrolyte used in the electrochemical reaction device 2 is shared as an absorption liquid of the absorption unit 12, and carbon dioxide dissolved in the electrolyte B is supplied to the electrochemical reaction device 2 to be electrochemically reduced. Accordingly, the energy required for desorption of carbon dioxide can be reduced compared to a case where, for example, carbon dioxide is adsorbed on an adsorbent, whereby the energy efficiency can increase and loss of carbon dioxide can also be reduced.

In the carbon dioxide treatment device 200, the liquid flow path 23*a* of the electrochemical reaction device 2 is connected to the electrolyte flow path 121 of the electrochemical reaction device 100 through the liquid flow path 66. In addition, the liquid flow path 67 is connected to the electrolyte flow path 121 of the electrochemical reaction device 100. For this reason, the electrolyte A flowing out of the liquid flow path 23*a* of the electrochemical reaction device 2 is supplied to the electrolyte flow path 121 of the electrochemical reaction device 100 through the liquid flow path 66. Then, the electrolyte A after a reaction in the electrochemical reaction device 100 flows out of the electrolyte flow path 121 to the liquid flow path 67.

The power source storage device 3 is a device that supplies electric power to the electrochemical reaction device 2 and the electrochemical reaction device 100.

Renewable energy is converted into electrical energy in the conversion unit 31. The conversion unit 31 is not particularly limited, and examples thereof include a wind power generator, a solar power generator, and a geothermal power generator. The number of conversion units 31 included in the power source storage device 3 may be one or two or more.

The electrical energy converted in the conversion unit 31 is stored in the storage unit 32. By storing the converted electrical energy in the storage unit 32, electric power can be stably supplied to the electrochemical reaction device 2 even during a period of time when the conversion unit is not generating power. In addition, in a case where renewable energy is used, voltage fluctuations generally tend to be large. However, once renewable energy is stored in the storage unit 32, electric power can be supplied to the electrochemical reaction device 2 at a stable voltage.

The storage unit 32 in this example is a nickel-hydrogen battery. Regarding the storage unit 32, any one may be used as long as charging and discharging can be performed. For example, a lithium-ion secondary battery or the like may be used.

Figure 8:
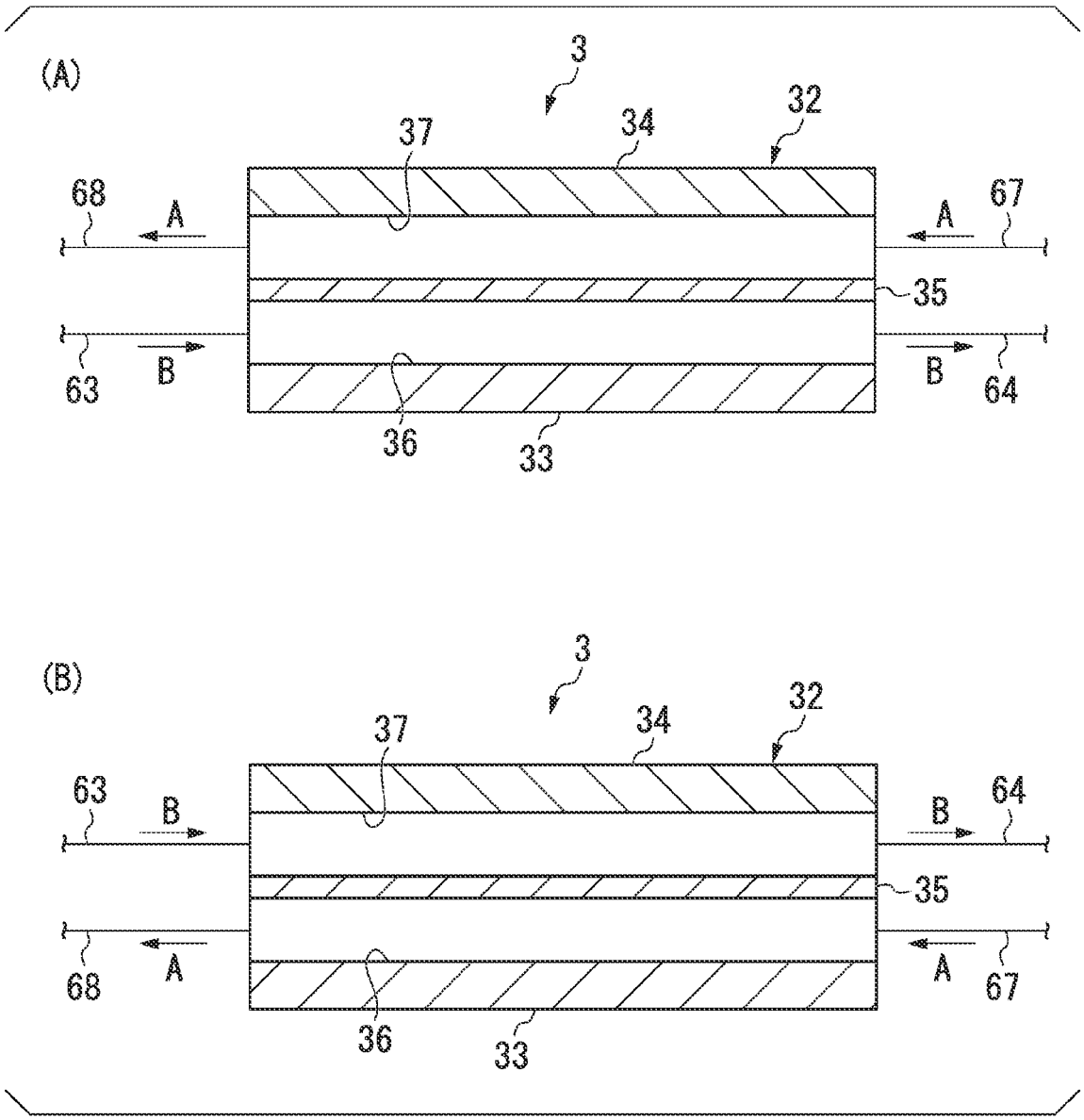
FIG. 8 is a cross-sectional view showing a nickel-hydride battery which is an example of a storage unit of the carbon dioxide treatment device of FIG. 6.

The storage unit 32 is a nickel-hydrogen battery including a positive electrode 33, a negative electrode 34, a separator 35 provided between the positive electrode 33 and the negative electrode 34, a positive electrode side flow path 36 formed between the positive electrode 33 and the separator 35, and a negative electrode side flow path 37 formed between the negative electrode 34 and the separator 35 as shown in FIG. 8(A). The positive electrode side flow path 36 and the negative electrode side flow path 37 can be formed using the same liquid flow path structure as the liquid flow path structure 114 of the electrochemical reaction device 100, for example.

Examples of the positive electrode 33 include one obtained by applying a positive electrode active material to the positive electrode side flow path 36 of a positive electrode current collector.

The positive electrode current collector is not particularly limited, and examples thereof include nickel foil and nickel-plated metal foil.

The positive electrode active material is not particularly limited, and examples thereof include nickel hydroxide and nickel oxyhydroxide.

Examples of the negative electrode 34 include one obtained by applying a negative electrode active material to the negative electrode side flow path 37 of a negative electrode current collector.

The negative electrode current collector is not particularly limited, and examples thereof include a nickel mesh.

The negative electrode active material is not particularly limited, and examples thereof include a well-known hydrogen storage alloy The separator 35 is not particularly limited, and examples thereof include an ion-exchange membrane.

The nickel-hydrogen battery which is the storage unit 32 is a flow cell in which electrolytes flow through the positive electrode side flow path 36 of the separator 35 on the positive electrode 33 side and the negative electrode side flow path 37 of the separator 35 on the negative electrode 34 side. In the carbon dioxide treatment device 200, the electrolyte B supplied from the absorption unit 12 through the liquid flow path 63 and the electrolyte A supplied from the electrochemical reaction device 100 through the liquid flow path 67 flow through the positive electrode side flow path 36 and the negative electrode side flow path 37, respectively. In addition, the connection of the liquid flow paths 63 and 64 to the storage unit 32 can be switched between a state of being connected to the positive electrode side flow path 36 and a state of being connected to the negative electrode side flow path 37. Similarly, the connection of the liquid flow paths 67 and 68 to the storage unit 32 can be switched between a state of being connected to the positive electrode side flow path 36 and a state of being connected to the negative electrode side flow path 37.

Hydroxide ions are generated from water molecules in the negative electrode when the nickel-hydrogen battery is discharged, and the hydroxide ions transferred to the negative electrode receive hydrogen ions from the hydrogen storage alloy to generate water molecules. For this reason, from the viewpoint of discharge efficiency, it is advantageous for the electrolyte flowing through the positive electrode side flow path 36 to be in a weak alkaline state and it is advantageous for the electrolyte flowing through the negative electrode side flow path 37 to be in a strong alkaline state. For this reason, during discharge, as shown in FIG. 8(A), it is preferable that the liquid flow paths 63 and 64 be connected to the positive electrode side flow path 36 and the liquid flow paths 67 and 68 be connected to the negative electrode side flow path 37 to make the (weak alkaline) electrolyte B supplied from the absorption unit 12 flow through the positive electrode side flow path 36 and to make the (strong alkaline) electrolyte A supplied from the electrochemical reaction device 100 flow through the negative electrode side flow path 37. That is, it is preferable that the electrolytes circulate in order of the absorption unit 12, the positive electrode side flow path 36 of the storage unit 32, the electrochemical reaction device 2, the electrochemical reaction device 100, the negative electrode side flow path 37 of the storage unit 32, and the absorption unit 12 during discharge.

In addition, when the nickel-hydrogen battery is charged, water molecules are generated from hydroxide ions in the positive electrode and dissolved in hydrogen atoms and hydroxide ions in the negative electrode, and the hydrogen atoms are stored in the hydrogen storage alloy. For this reason, from the viewpoint of charge efficiency, it is advantageous for the electrolyte flowing through the positive electrode side flow path 36 to be in a strong alkaline state and it is advantageous for the electrolyte flowing through the negative electrode side flow path 37 to be in a strong alkaline state. For this reason, during charge, as shown in FIG. 8(B), it is preferable that the liquid flow paths 63 and 64 be connected to the negative electrode side flow path 37 and the liquid flow paths 67 and 68 be connected to the positive electrode side flow path 36 to make the (weak alkaline) electrolyte B supplied from the absorption unit 12 flow through the negative electrode side flow path 37 and to make the (strong alkaline) electrolyte A supplied from the electrochemical reaction device 100 flow through the positive electrode side flow path 36. That is, it is preferable that the electrolytes circulate in order of the absorption unit 12, the negative electrode side flow path 37 of the storage unit 32, the electrochemical reaction device 2, the electrochemical reaction device 100, the positive electrode side flow path 36 of the storage unit 32, and the absorption unit 12 during charge.

In general, when a secondary battery is incorporated in a device, the overall energy efficiency tends to decrease by the amount of charge-discharge efficiency. However, by appropriately replacing the electrolytes flowing through the positive electrode side flow path 36 and the negative electrode side flow path 37 of the storage unit 32 using pH gradients of the electrolyte A and the electrolyte B before and after the electrochemical reaction device 2 and the electrochemical reaction device 100 as described above, it is possible to improve the charge-discharge efficiency of "concentration overvoltage" of an electrode reaction represented by the Nernst equation.

The homologation reaction device 4 is a device for increasing the number of carbons by multimerizing ethylene produced by reducing carbon dioxide in the electrochemical reaction device 2 and the electrochemical reaction device 100.

Gaseous products C1 and C2 containing ethylene gas produced by reduction in the electrochemical reaction device 2 and the electrochemical reaction device 100 are sent to the reactor 41 through the gas flow paths 70 and 71. In the reactor 41, the ethylene multimerization reaction is performed in the presence of an olefin multimerization catalyst. Accordingly, olefins having an extended carbon chain such as 1-butene, 1-hexene, and 1-octene can be produced, for example.

The olefin multimerization catalyst is not particularly limited, and a well-known catalyst used for a multimerization reaction can be used. Examples thereof include a transition metal complex compound and a solid acid catalyst using a zeolite.

In the homologation reaction device 4 in this example, a produced gas D after the multimerization reaction flowing out of the reactor 41 is sent to the gas-liquid separator 42 through the gas flow path 72. An olefin having 6 or more carbon atoms is a liquid at normal temperature. For this reason, in a case where, for example, olefins having 6 or more carbon atoms are used as target carbon compounds, by setting the temperature of the gas-liquid separator 42 to about 30° C., it is possible to easily perform gas-liquid separation into olefins having 6 or more carbon atoms (olefin liquid E1) and olefins having less than 6 carbon atoms (olefin gas E2). In addition, by increasing the temperature of the gas-liquid separator 42, the number of carbon atoms of the obtained olefin liquid E1 can be increased.

If the gas G1 supplied to the concentration unit 11 of the recovery device 1 is atmospheric air, the separation gas G4 sent from the concentration units 11 and 13 through the gas flow path 74 may be used for cooling the produced gas D in the gas-liquid separator 42. For example, the separation gas G4 is passed through a cooling tube using the gas-liquid separator 42 including the cooling tube, and the produced gas D is passed outside the cooling tube and is aggregated on the surface of the cooling tube to obtain the olefin liquid E1. In addition, since the olefin gas E2 separated in the gas-liquid separator 42 contains unreacted components such as ethylene or olefins having a smaller number of carbon atoms than that of a target olefin, it can be returned to the reactor 41 through the gas flow path 73 to be reused for a multimerization reaction.

The ethylene multimerization reaction in the reactor 41 is an exothermic reaction in which a supplied material has a higher enthalpy than a produced material and the reaction enthalpy is negative. In the carbon dioxide treatment device 200, the electrolyte B is heated in the heat exchanger 5 using the reaction heat generated in the reactor 41 of the homologation reaction device 4. In the electrolyte B in which a strong alkaline aqueous solution is used, dissolved carbon dioxide is less likely to be separated as a gas even if the temperature is raised, and the redox reaction rate in the electrochemical reaction device 2 is improved by raising the temperature of the electrolyte B.

The homologation reaction device 4 may further include a well-known reactor that performs a hydrogenation reaction of olefins obtained by multimerizing ethylene using hydrogen produced in the electrochemical reaction devices 2 and 100 or an isomerization reaction of olefins or paraffins.

Carbon Dioxide Treatment Method

Hereinafter, a carbon dioxide treatment method using the carbon dioxide treatment device 200 will be described. This carbon dioxide treatment method can be used, for example, for a method for producing carbon compounds such as olefins such as 1-hexene or paraffins such as i-hexane. In the carbon dioxide treatment method using the carbon dioxide treatment device 200, an exhaust gas, atmospheric air, or the like is supplied as the gas G1 to the concentration unit 11, and carbon dioxide is concentrated to obtain a concentrated gas G2. As described above, since absorption of carbon dioxide in the electrolyte A in the absorption unit 12 assists the concentration, it is unnecessary to concentrate carbon dioxide in the concentration unit 11 to a high concentration. The concentration of carbon dioxide in the concentrated gas G2 can be appropriately set, for example, to 25 to 85 volume %.

A part of the concentrated gas G2 from the concentration unit 11 is supplied to the absorption unit 12 and brought into contact with the electrolyte A, and carbon dioxide in the concentrated gas G2 is dissolved and absorbed in the electrolyte A. The electrolyte B in which the carbon dioxide is dissolved is in a weak alkaline state. In addition, the electrolyte B is supplied from the absorption unit 12 to the heat exchanger 5 through the storage unit 32, heated, and supplied to the electrochemical reaction device 2. The temperature of the electrolyte B supplied to the electrochemical reaction device 2 can be appropriately set, for example, to 65° C. to 105° C.

The electrolyte B is allowed to flow through the liquid flow path 23*a* of the electrochemical reaction device 2, electric power is applied from the power source storage device 3 to the electrochemical reaction device 2, and a voltage is applied between the cathode 21 and the anode 22. Then, dissolved carbon dioxide in the electrolyte B is electrochemically reduced at the cathode 21 to generate a gaseous product C1 containing ethylene and hydrogen. At this time, hydroxide ions in the electrolyte B are oxidized at the anode 22 to generate oxygen. The amount of dissolved carbon dioxide in the electrolyte B decreases as the reduction progresses, and the electrolyte A in a strong alkaline state flows out of the outlet of the liquid flow path 23*a*. The gaseous product C1 produced by the reduction permeates the gas diffusion layer of the cathode 21, flows out of the electrochemical reaction device 2 through the gas flow path 24*a*, and is sent to the homologation reaction device 4.

In addition, a part of the concentrated gas G2 is supplied from the concentration unit 11 to the concentration unit 13, and the concentrated gas G3 in which carbon dioxide is concentrated is further supplied to the electrochemical reaction device 100. Since the carbon dioxide is supplied as a gas to the electrochemical reaction device 100, there is no concentration assist, such as the absorption unit 12, by absorption in the electrolyte A. Therefore, the carbon dioxide of the concentrated gas G2 obtained in the concentration unit 11 is further concentrated in the concentration unit 13 to obtain the concentrated gas G3. The concentration of carbon dioxide in the concentrated gas G3 can be appropriately set, for example, to 80 to 100 volume %.

In the electrochemical reaction device 100, the carbon dioxide gas is electrochemically reduced as described above to produce a gaseous product C2 having a high ethylene concentration.

The gaseous products C1 and C2 containing ethylene produced by the carbon dioxide reduction in the electrochemical reaction device 2 and the electrochemical reaction device 100 are sent to the reactor 41 and brought into contact with an olefin multimerization catalyst in a gas phase in the reactor 41 to multimerize ethylene. Accordingly, olefins obtained by multimerizing ethylene are obtained. For example, in a case where olefins having 6 or more carbon atoms are used as target carbon compounds, the produced gas D coming out of the reactor 41 is sent to the gas-liquid separator 42 and cooled to about 30° C. Then, the target olefins (for example, 1-hexene) having 6 or more carbon atoms are liquefied and olefins having less than 6 carbon atoms remain as gases. Therefore, the olefins can be easily separated into an olefin liquid E1 (target carbon compound) and olefin gas E2. The number of carbons of the olefin liquid E1 and the olefin gas E2 to be subjected to gas-liquid separation can be adjusted by the temperature during the gas-liquid separation.

The olefin gas E2 after the gas-liquid separation can be returned to the reactor 41 to be reused for a multimerization reaction. In this manner, in a case where an olefin having a smaller number of carbon atoms than that of a target olefin is circulated between the reactor 41 and the gas-liquid separator 42, it is preferable that the contact time between the raw material gas (mixed gas of the gaseous product C and the olefin gas E2) and the catalyst be adjusted in the reactor 41 to control the conditions so that each molecule causes an average of one multimerization reaction. Accordingly, the number of carbon atoms in the olefins produced in the reactor 41 is suppressed from being unintentionally increased. Therefore, the olefin (olefin liquid E1) having a target number of carbon atoms can be selectively separated in the gas-liquid separator 42.

According to such a method, it is possible to efficiently obtain valuables from a renewable carbon source with high selectivity. For this reason, such a method does not require a large refining facility such as a distillation tower required in petrochemistry in the related art in which a Fischer-Tropsch (FT) synthesis method or an MTG method, and is therefore economically advantageous overall.

The mode of using the electrochemical reaction device according one aspect of the present invention is not limited to the above-described carbon dioxide treatment device 200.

Figure 9:
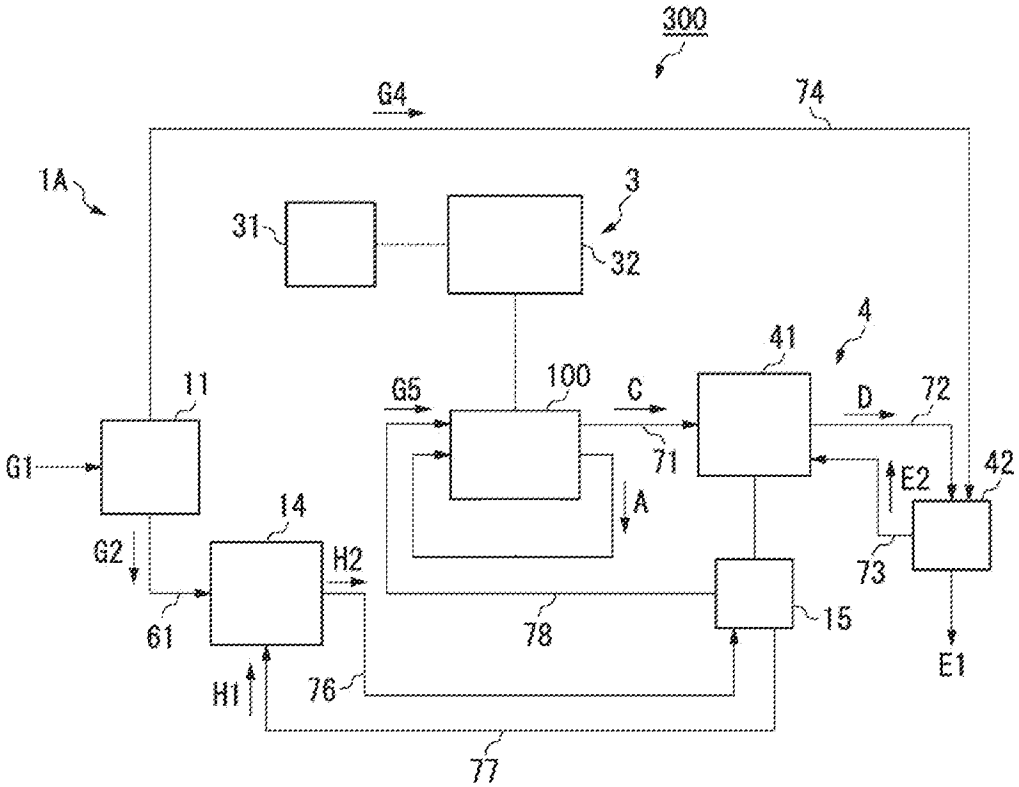
FIG. 9 is a block diagram illustrating another example of a carbon dioxide treatment device including an electrochemical reaction device of an embodiment.

For example, a carbon dioxide treatment device 300 provided as an exemplary example in FIG. 9 may be used. In the carbon dioxide treatment device 300, the same portions as those of the carbon dioxide treatment device 200 will be denoted by the same reference numerals, and description thereof will not be repeated. The carbon dioxide treatment device 300 is the same mode as the carbon dioxide treatment device 200 except that it includes a recovery device 1A instead of the recovery device 1 and does not include the electrochemical reaction device 2.

The recovery device 1A includes a concentration unit 11, an absorption unit 14, and a release unit 15. The concentration unit 11 and the absorption unit 14 are connected to each other through a gas flow path 61. The absorption unit 14 and the release unit 15 are connected to each other through a liquid flow path 76 and a liquid flow path 77. The release unit 15 and an electrochemical reaction device 100 are connected to each other through a gas flow path 78. Gas feeding means such as a compressor, pressure reduction valves, or measuring instruments such as a pressure gauge can be appropriately installed in the gas flow path 78. In addition, liquid feeding means such as a pump or measuring instruments such as a flowmeter can be appropriately installed in the liquid flow paths 76 and 77.

In the recovery device 1A, a concentrated gas G2 obtained by concentrating carbon dioxide in the concentration unit 11 is sent to the absorption unit 14 through the gas flow path 61. In the absorption unit 14, the carbon dioxide gas in the concentrated gas G2 supplied from the concentration unit 11 comes into contact with an absorption liquid H1 and is dissolved and absorbed in the absorption liquid H1.

The technique of bringing the carbon dioxide gas into contact with the absorption liquid H1 is not particularly limited, and examples thereof include a technique of blowing the concentrated gas G2 into the absorption liquid H1 for bubbling.

Regarding the absorption liquid H1, any one may be used as long as it can absorb carbon dioxide and release carbon dioxide gas through heating, and examples thereof include ethanolamine An absorption liquid H2 in which carbon dioxide is absorbed in the absorption unit 14 is sent to the release unit 15 through the liquid flow path 76. In the release unit 15, the absorption liquid H2 is heated using heat generated in a reactor 41 of a homologation reaction device 4, and carbon dioxide gas G5 is released from the absorption liquid H2. A well-known heat exchanger can be used as the release unit 15, for example.

The carbon dioxide gas G5 released from the release unit 15 is sent to a cathode-side gas flow path 122 of the electrochemical reaction device 100 through the gas flow path 78. The absorption liquid H1 obtained by releasing carbon dioxide in the release unit 15 is returned to and circulated in the absorption unit 14 through the liquid flow path 77.

In the carbon dioxide treatment device 300, electrolytes are not shared between the absorption unit 14, a power source storage device 3, and the electrochemical reaction device 100.

In the carbon dioxide treatment method in which the carbon dioxide treatment device 300 is used, the concentrated gas G2 in which carbon dioxide is concentrated in the concentration unit 11 is supplied to the absorption unit 14 and brought into contact with the absorption liquid H1, and the carbon dioxide in the concentrated gas G2 is dissolved and absorbed in the absorption liquid H1. The absorption liquid H2 in which carbon dioxide is absorbed is sent to the release unit 15 and heated using heat supplied from the reactor 41 to release the carbon dioxide gas G5. The carbon dioxide gas G5 released is supplied to the cathode-side gas flow path 122 of the electrochemical reaction device 100, and the carbon dioxide is reduced as described above. Then, a gaseous product C which contains ethylene and is produced in a cathode 113 of the electrochemical reaction device 100 is sent to the homologation reaction device 4, and the ethylene is multimerized in the same manner as in the case of the carbon dioxide treatment device 200.

In addition, in the reduction of carbon dioxide in an electrochemical reaction device, ethanol is also produced. For this reason, the carbon dioxide treatment devices 200 and 300 may have, for example, a mode including an ethanol purification device instead of the homologation reaction device 4 or a mode further including an ethanol purification device in addition to the homologation reaction device 4. In this case, since ethanol is discharged from an electrochemical reaction device as a liquid mixed with an electrolyte A, a mode in which the ethanol is separated from the electrolyte A using a distillation tower and a gas-liquid separator can be employed for the ethanol purification device.

In addition, the carbon dioxide treatment devices 200 and 300 may have a mode including no homologation reaction device.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1, 1A Recovery device

2 Electrochemical reaction device

3 Power source storage device
4 Homologation reaction device
5 Hear exchanger
100 Electrochemical reaction device
111 First power supply body
112 First gas flow path structure
113 Cathode
114 Gas flow path structure
115 Anode
116 Second gas flow path structure
117 Second power supply body
118 Gas flow path closing means
119 liquid flow path closing means
121 Electrolyte flow path
122 Cathode-side gas flow path
123 Gas exhaust path
131 First liquid electromagnetic valve
132 Second liquid electromagnetic valve
133 First gas electromagnetic valve
134 Second gas electromagnetic valve
135 Third gas electromagnetic valve
141 Pressure sensor
142 Carbon dioxide sensor
200, 300 Carbon dioxide treatment device

What is claimed is:

1. An electrochemical reaction device that electrochemically reduces carbon dioxide, comprising:

a cathode;

an anode;

an electrolyte flow path which is provided between the cathode and the anode and through which an electrolyte containing an alkaline aqueous solution is supplied;

a cathode-side gas flow path which is provided on a cathode side opposite to the anode and through which carbon dioxide gas is supplied;

liquid flow path closing means for openably closing an entrance of the electrolyte flow path;

gas flow path closing means for openably closing an entrance of the cathode-side gas flow path;

a voltage applying means for applying and controlling a voltage between the cathode and the anode by supplying electric power to a first power supply body and a second power supply body; and a groove formed in a gas flow path structure on a side where the anode is placed, wherein a portion of the groove surrounded by the gas flow path structure and the anode forms a gas exhaust path, wherein a pressure sensor for monitoring pressure in the cathode-side gas flow path and a carbon dioxide sensor for monitoring carbon dioxide concentration are provided in the cathode-side gas flow path, wherein the liquid flow path closing means comprises a first liquid electromagnetic valve and a second liquid electromagnetic valve which openably close entrances of the electrolyte flow path, wherein the first liquid electromagnetic valve is provided in an inlet of the electrolyte flow path, and the second liquid electromagnetic valve is provided in an outlet of the electrolyte flow path, wherein the gas flow path closing means comprises a first gas electromagnetic valve and a second gas electromagnetic valve which openably close entrances of the cathode-side gas flow path, wherein a third gas electromagnetic valve is provided in an inlet of the gas exhaust path, wherein the first gas electromagnetic valve is provided in an inlet of the cathode-side gas flow path, and the second gas electromagnetic valve is provided in an outlet of the cathode-side gas flow path, wherein carbon dioxide gas is electrochemically reduced by applying voltage between the cathode and the anode in a state in which the electrolyte is accommodated in an electrolyte flow path of which the entrance is closed and in a state in which the carbon dioxide gas is accommodated in the cathode-side gas flow path of which the entrance is closed, wherein unreacted carbon dioxide gas remaining in the cathode-side gas flow path is dissolved in the electrolyte, and wherein the entrances of the electrolyte flow path are closed in a state in which the electrolyte is accommodated by closing the first liquid electromagnetic valve and the second liquid electromagnetic valve, and then the entrances of the cathode-side gas flow path are closed in a state in which the carbon dioxide gas is accommodated by closing the first gas electromagnetic valve and the second gas electromagnetic valve.

2. A method for electrochemically reducing carbon dioxide, comprising:

electrochemically reducing carbon dioxide gas in a state in which an electrolyte containing a strong alkaline aqueous solution is accommodated in an electrolyte flow path which is located between a cathode and an anode and of which an entrance is closed and in a state in which the carbon dioxide gas is accommodated in a cathode-side gas flow path which is on the cathode side opposite to the anode and of which an entrance is closed, to dissolve the unreacted carbon dioxide gas in the electrolyte.

3. A method for producing a carbon compound, comprising:

electrochemically reducing carbon dioxide through the method for reducing carbon dioxide according to claim 2 to produce the carbon compound.

4. The electrochemical reaction device of claim 1, wherein the electrolyte flow path comprises a fluororesin material.

5. The electrochemical reaction device of claim 4, wherein the fluororesin material comprises polytetrafluoroethylene.

* * * * *